United States Patent [19]

Edmisten

[11] 4,077,319

[45] Mar. 7, 1978

[54] APPARATUS FOR IDENTIFYING THE LOAD CHARACTERISTICS OF A CENTERFIRE FIREARM CARTRIDGE

[76] Inventor: John H. Edmisten, P.O. Box 201, Boone, N.C. 28607

[21] Appl. No.: 692,844

[22] Filed: Jun. 4, 1976

[51] Int. Cl.[2] ..... B41F 17/16; B41F 17/36

[52] U.S. Cl. ..... 101/41; 101/379

[58] Field of Search ..... 101/368, 379, 35, 41, 101/4, 11, 380, 44, 426; 86/36, 37, 38, 23, 1 R

[56] References Cited

U.S. PATENT DOCUMENTS

| | | | |
|---|---|---|---|
| 328,750 | 10/1885 | Baxter | 86/37 X |
| 735,047 | 8/1903 | Alsop | 86/36 |
| 1,253,463 | 1/1918 | Brown | 101/4 |
| 2,184,510 | 12/1939 | Adams | 101/379 |
| 2,284,628 | 6/1942 | Almgren | 101/44 |
| 3,019,762 | 2/1962 | Hautz | 101/35 UX |
| 3,045,593 | 7/1962 | Petterson | 101/368 |
| 3,194,152 | 7/1965 | Rubinoff | 101/368 X |
| 3,389,654 | 6/1968 | Hirt | 101/35 |
| 3,703,142 | 11/1972 | Mimlitch | 101/368 X |

FOREIGN PATENT DOCUMENTS

| | | | |
|---|---|---|---|
| 424,947 | 3/1935 | United Kingdom | 101/35 |

*Primary Examiner*—Clifford D. Crowder

*Attorney, Agent, or Firm*—Bell, Seltzer, Park & Gibson

[57] ABSTRACT

Apparatus for identifying the load characteristics of a centerfire firearm cartridge which has been loaded by a process including insertion of an unstruck primer into a primer pocket in the cartridge head and in which indicia identifying the load characteristics of the cartridge are imprinted onto the unstruck primer. The apparatus is contemplated as being particularly useful with reloaded cartridges which are to be again reloaded subsequent to use.

5 Claims, 6 Drawing Figures

APPARATUS FOR IDENTIFYING THE LOAD CHARACTERISTICS OF A CENTERFIRE FIREARM CARTRIDGE

Sportmen and others knowledgeable in the use of firearms using centerfire cartridges are aware of the desirability of identifying the load characteristics of a cartridge in order to assure that a desired effect is achieved. This need for identifying the load characteristics of a centerfire firearm cartridge extends over a wide range of cartridge types and uses, from the carefully crafted cartridge used by a bench rest shooter seeking extreme accuracy to the shot shell chosen by a hunter seeking a particular game bird. Heretofore, this need has been met, in the instance of factory loaded ammunition, by imprinting of indicia on shot shell cartridge cases and on boxes containing centerfire ammunition. While such approaches may in many instances meet the needs of sportmen and others purchasing and using factory ammunition, the needs of persons using reloaded cartridges are not met.

In connection with the reloading and reuse of centerfire firearm cartridge cases, it has become conventional for persons undertaking reloading to maintain records identifying the load characteristics of cartridges. In some instances, such records are duplicated in diaries or logbooks and on labels attached to boxes containing the reloaded cartridges. As can be appreciated, successive reloading of a particular group of cartridge cases may involve the use of varying load characteristics, introducing the danger of confusion where such marked boxes are employed.

With the foregoing in mind, it is an object of the present invention to facilitate the identification of the load characteristics of centerfire firearm cartridges. In realizing this object of the present invention, indicia identifying the load characteristics of a loaded cartridge are imprinted onto an unstruck primer inserted into a primer pocket in the cartridge case head. Such an indicia applied to a primer is removed from the cartridge case upon any subsequent reloading, thereby precluding confusion of indicia.

Yet a further object of this invention is the provision of apparatus readily usable in conjunction with the loading of cartridges by procedures which include inserting an unstruck primer into a primer pocket in a cartridge case head. Through the use of the apparatus of this invention, an unstruck primer disposed in a cartridge head primer pocket is positioned in alignment with a predetermined axis and a plunger mounted for movement along the axis imprints indicia thereonto.

Yet a further object of this invention is the provision of manually operable apparatus including a body configured for engagement in the hand of a user and having a multi part plunger assembly for accommodating imprinting of indicia while avoiding exertion of excessive force on an unstruck primer. In realizing this object of the present invention, force appropriate for the imprinting of indicia is provided while ready manual operation of the apparatus is facilitated.

Some of the objects of the invention having been stated, other objects will appear as the description proceeds, when taken in connection with the accompanying drawings, in which FIG. 1 is a perspective view illustrating an apparatus of the present invention in use in practice of the method of the present invention;

While the present invention will be described more fully hereinafter with particular reference to the accompanying drawings, it is to be noted at the outset of this description that the present invention is contemplated as having utility in forms and in accordance with procedures differing from those to be particularly described. Accordingly, it is contemplated that the following description and the referenced illustrations be taken as a general teaching directed broadly to persons skilled in the appropriate arts, and not be taken as being restrictive upon this invention.

Figure 1:
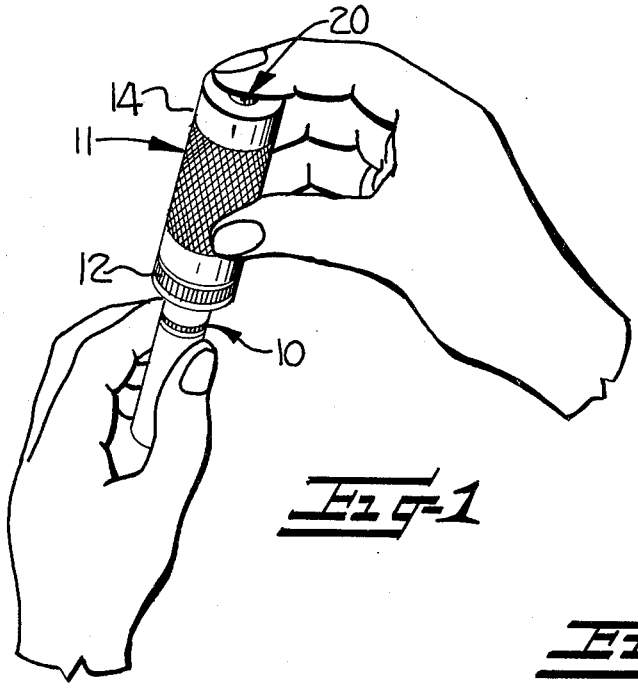
Figure 2:
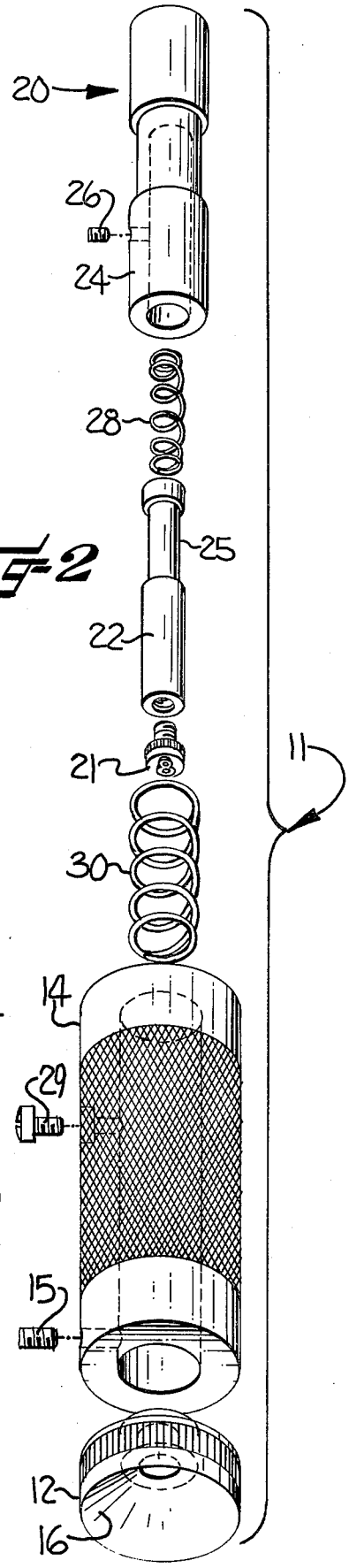
FIG. 2 is an exploded perspective view of the apparatus of FIG. 1.

Referring now more particularly to the accompanying drawings, the apparatus of the present invention imprints onto an unstruck primer of a centerfire firearm cartridge (such as a shotgun shell generally indicated at 10 in FIG. 1) indicia identifying the load characteristics of the cartridge. While a shot shell 10 is generally indicated in FIG. 1, it is contemplated that the apparatus and method of this invention have utility with centerfire firearm cartridges of any and all sizes including particularly pistol and rifle cartridges, and a shot shell cartridge has been chosen only for purposes of convenience in illustrating this invention.

In the use of the apparatus, a head portion of a cartridge 10 is received in a body means generally indicated at 11. In the form illustrated, the body means 11 comprises two portions including a centering means 12 and a manually engageable generally cylindrical member 14. The centering means 12 generally has the form of a plug or button and is secured adjacent one end of the cylindrical member 14 by a set screw 15 or the like.

As illustrated in FIGS. 2–5, the centering means 12 defines an inwardly converging conical surface 16 concentric with a longitudinal axis of the cylindrical member 14. By means of the conical surface 16, the head of an elongate centerfire cartridge brought into engagement with the centering means 12 is positioned with an unstruck primer received in a primer pocket thereof disposed in alignment with the central longitudinal axis of the body 11 and so as to position the cartridge generally co-directionally with the axis. While it will be appreciated that the principal plane of the face of the cartridge head may not be precisely perpendicular to such a predetermined axis, the use of two hands in guiding the cylindrical member 14 and a shell 10 (as illustrated in FIG. 1) aids and facilitates substantial perpendicularity.

Figure 3:
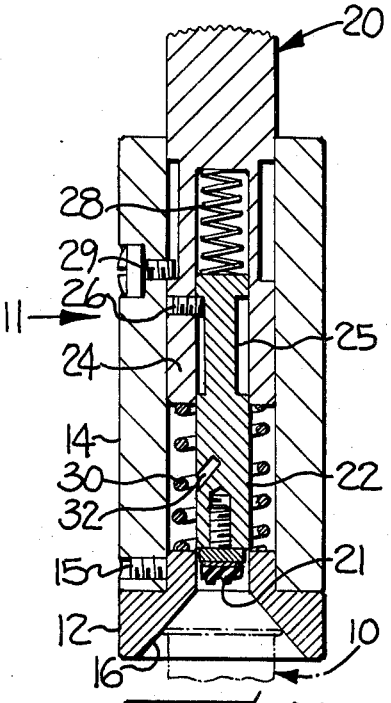
FIG. 3 is an elevation view, partially in section and partially in phantom lines, illustrating the apparatus of FIGS. 1 and 2 in one position of use.
Figure 4:
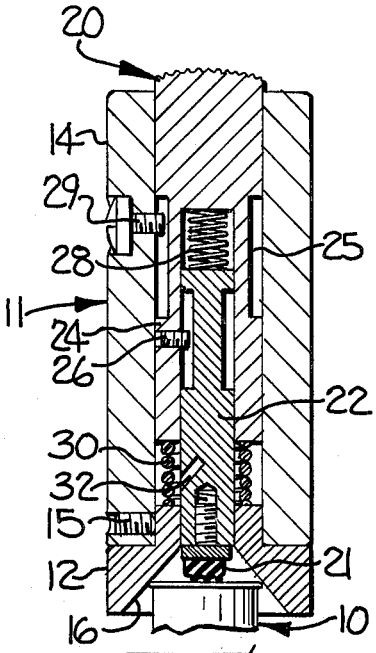
FIG. 4 is a view similar to FIG. 2, illustrating another position of use.
Figure 5:
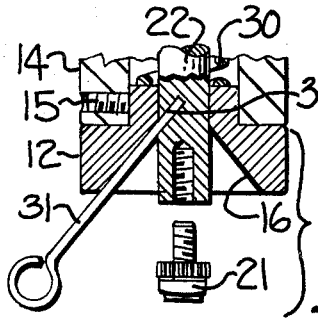
FIG. 5 is a partial elevation view, somewhat similar to FIGS. 3 and 4, illustrating the changing of indicia to be imprinted in accordance with the present invention.

Mounted for movement relative to the body means 11 and along the axis is a plunger means generally indicated at 20. The plunger means bears an indicia element 21 and functions for imprinting indicia onto an unstruck primer of a cartridge received by the body means 11. As visible in FIG. 2, the indicia borne by the element 21 may be any alphanumeric character, such as a numeral or letter or combination of numerals and letters. Preferably, the indicia element is faced with an elastomeric material such as is conventionally used for rubber stamps and the like and is threadingly received in an indicia bearing plunger 22. The indicia bearing plunger 22 is telescopically received within an actuating plunger 24 and is provided with a reduced diameter portion 25 which cooperates with a set screw 26 penetrating the actuating plunger means 24 to capture the indicia bearing plunger means 22 against withdrawal from within the actuating plunger 24. By means of a suitable spring 28 or the like, the indicia bearing plunger means 22 is biased toward an extended position relative to the actuating plunger 24 (FIG. 3).

The actuating plunger 24 is similarly captured within the cylindrical member 14 by a lock screw 29 and is biased toward a retraeted position (FIG. 3) by an appropriate spring 30.

In use, ink of a desired coloration is supplied in or applied to the indicia element 21. Thereafter, the head of a centerfire firearm cartridge to be imprinted is positioned for imprinting (as indicated by phantom lines in FIG. 3 and by full lines in FIGS. 1 and 4). The plunger means 20 is then depressed manually relative to the body means 11 (FIGS. 1 and 4), compressing the spring 30 which normally maintains the plunger means in retracted position. Thereupon, a force determined by the spring 28 which couples the indicia bearing plunger means 22 and the actuating plunger means 24 urges the indicia element 21 into engagement with an unstruck primer, applying an indicia of the selected coloration and alphanumeric character.

Figure 6:
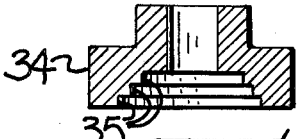
FIG. 6 is an elevation view, in section, showing an alternate form of a centering element used in the apparatus of this invention.

When it is desired to change the coloration and/or alphanumeric character applied, the indicia bearing plunger means is extended in the absence of a cartridge (FIG. 5) and a locking pin 31 is inserted into a suitable angled bore 32 formed in the indicia bearing plunger 22. The threaded engagement of the indicia element 21 therewith may then be undone, to permit substitution of another selected indicia element.

Where desired, the centering means 12 having a conical surface 16 may be replaced by an alternate centering means 34 (FIG. 6) having a stepped series of circular recesses 35 of progressively decreasing diameters. Each of the recesses is concentric with the axis of the apparatus and is sized to receive a corresponding head diameter. By way of example, a stepped series of circular recesses may be sized to receive the heads of shot shell cartridges in the series of sizes including 10 gauge, 12 gauge, 16 gauge, 20 gauge and 28 gauge. Such an apparatus would permit a sportman engaging in competitive shotgun target games such as trap or skeet to apply indicia identifying load characteristics of cartridges to a series of selected cartridge sizes.

In use in the form illustrated, a centerfire firearm cartridge which has been loaded by a process including insertion of an unstruck primer is positioned and has indicia identifying the load characteristics of the loaded cartridge imprinted onto the unstruck primer. In instances where the cartridge is subsequently reloaded, the removal of the struck primer and insertion of an unstruck primer removes from the centerfire firearm cartridge those indicia which identified the load characteristics of the prior load and permits imprinting onto the unstruck primer indicia coded for identifying the load characteristics of the cartridge after reloading.

While described hereinabove with particular reference to an apparatus and process performed as a step subsequent to the loading or reloading of a cartridge, it is contemplated that the method and apparatus of this invention may be adapted to and incorporated in processes for reloading in such a manner as to apply indicia concurrently with some other reloading steps such as bullet seating or crimping.

In the drawings and specification, there has been set forth a preferred embodiment of the invention, and although specific terms are employed, they are used in a generic and descriptive sense only and not for purposes of limitation.

That which is claimed is:

1. Apparatus for imprinting, onto an unstruck primer of an elongate centerfire firearm cartridge, indicia identifying the load characteristics of the cartridge and comprising means for receiving a head portion of a cartridge and including centering surface means for positioning an unstruck primer disposed in a cartridge head primer pocket in alignment with a predetermined axis and the cartridge generally co-directionally with said axis, said centering surface means defining an inwardly converging conical surface concentric with said axis, and plunger means mounted for movement relative to said centering surface means along said axis for imprinting indicia onto an unstruck primer of a cartridge engaged thereby.

2. Apparatus according to claim 1 wherein said plunger means comprises indicia bearing plunger means movable along said axis and into said centering surface means and actuating plunger means telescopically associated with said indicia bearing plunger means for moving the same while resiliently accommodating abutment of said indicia bearing plunger means with a primer to be imprinted.

3. Apparatus for imprinting, onto an unstruck primer of an elongate centerfire firearm cartridge, indicia identifying the load characteristics of the cartridge and comprising means for receiving a head portion of a cartridge and including centering surface means for positioning an unstruck primer disposed in a cartridge head primer pocket in alignment with a predetermined axis and the cartridge generally co-directionally with said axis, said centering surface means defining a stepped series of circular recesses of progressively decreasing diameters, each of said recesses being concentric with said axis, and plunger means mounted for movement relative to said centering surface means along said axis for imprinting indicia onto an unstruck primer of a cartridge engaged thereby.

4. Apparatus according to claim 3 wherein said plunger means comprises indicia bearing plunger means movable along said axis and into said centering surface means and actuating plunger means telescopically associated with said indicia bearing plunger means for moving the same while resiliently accommodating abutment of said indicia bearing plunger means with a primer to be imprinted.

5. Apparatus for imprinting, onto an unstruck primer of an elongate reloaded centerfire firearm cartridge, indicia identifying the load characteristics of the reloaded cartridge and comprising manually engageable body means, means mounted on said body means for receiving a head portion of a cartridge and including centering surface means for positioning an unstruck primer disposed in a cartridge head primer pocket in alignment with a predetermined axis and the cartridge generally co-directionally with said axis, indicia bearing plunger means mounted within said body means for movement relative thereto along said axis for imprinting indicia onto an unstruck primer of a reloaded cartridge engaged by said centering surface means, and actuating plunger means mounted for movement relative to said body means along said axis and telescopically with said indicia bearing plunger means for moving the same into engagement with a primer to be imprinted.

* * * * *

UNITED STATES PATENT AND TRADEMARK OFFICE

CERTIFICATE OF CORRECTION

PATENT NO. : 4,077,319

DATED : March 7, 1978

INVENTOR(S) : John H. Edmisten

It is certified that error appears in the above-identified patent and that said Letters Patent are hereby corrected as shown below:

Column 2, Line 6 following "view similar to FIG." delete "2" and insert therefor - 3 -.

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*